United States Patent [19]

Emanuelsson et al.

[11] Patent Number: 5,046,783

[45] Date of Patent: Sep. 10, 1991

[54] TUNNEL BORING MACHINE

[75] Inventors: Kaj B. I. Emanuelsson, Saltsjö-Boo; Carl S. M. Hartwig, Täby, both of Sweden

[73] Assignee: Atlas Copco MCT AB, Nacka, Sweden

[21] Appl. No.: 450,045

[22] Filed: Dec. 13, 1989

[30] Foreign Application Priority Data

Dec. 23, 1988 [SE] Sweden ..... 8804645

[51] Int. Cl.[5] ..... E21D 9/10; E21C 29/02

[52] U.S. Cl. ..... 299/31; 405/138

[58] Field of Search ..... 299/31, 33, 55, 56; 175/62; 405/138, 142, 145

[56] References Cited

U.S. PATENT DOCUMENTS

| | | | |
|---|---|---|---|
| 2,925,258 | 2/1960 | Robbins | 299/31 |
| 3,640,573 | 2/1972 | Safar | 299/31 |
| 3,643,999 | 2/1972 | Kampf-Emden et al. | 299/31 |

FOREIGN PATENT DOCUMENTS

| | | | |
|---|---|---|---|
| 126047 | 11/1984 | European Pat. Off. | 299/31 |
| 1534611 | 8/1969 | Fed. Rep. of Germany | 299/31 |
| 1377381 | 2/1988 | U.S.S.R. | 299/31 |

*Primary Examiner*—Ramon S. Britts
*Assistant Examiner*—David J. Bagnell
*Attorney, Agent, or Firm*—Eric Y. Munson; Mark P. Stone

[57] ABSTRACT

Tunnel boring machine comprising a transmission housing (11) which during boring is fixed relative to the tunnel. The boring head (15) is axially displaceable relative to an outgoing shaft (14) of the transmission housing while transferring torque from the outgoing shaft to the boring head. A number of fluid cylinders (16) are arranged between the transmission housing and a bearing housing (19,30) for the boring head in order to press the boring head against a tunnel front.

6 Claims, 1 Drawing Sheet

TUNNEL BORING MACHINE

BACKGROUND OF THE INVENTION

The present invention relates to a tunnel boring machine, i.e. a machine which bores the tunnel without the use of explosives.

During boring with a tunnel boring machine the boring head is pressed against the tunnel front with a large force at the same time as it is rotated. In order to take up the resulting reaction forces during the boring one relies on the tunnel wall. This is done so that a part of the machine is fixed relative to the tunnel wall. In a prior art tunnel boring machine the fixed part comprises a rectangular channel in which a long rectangular beam is movable to-and-fro. This beam carries at one end a bearing housing for the boring head and at the other end a gear box and a number of driving motors which, via a shaft journalled in the rectangular beam, drive the boring head. The boring head is pressed against the tunnel front by means of a number of hydraulic cylinders which are arranged between the gear case and the part fixed relative to the tunnel wall. The reaction moment arising during boring is thus transferred via the rectangular beam and the fixed part to the tunnel wall. Also the axial reaction force is transferred that way.

SUMMARY OF THE INVENTION

The present invention aims at achieving a tunnel boring machine where reaction forces and reaction moments are transferred directly to the surrounding tunnel wall from the driving device, preferably through having a transmission housing fixed relative to the tunnel by means of a number of clamping shoes. In order to be able to drive the boring head from a transmission housing fixed in the tunnel the boring head is axially displaceable on a shaft outgoing from the transmission housing and transferring torque to the boring head.

BRIEF DESCRIPTION OF THE DRAWING

An embodiment of the invention is described below with reference to the accompanying drawings in which.

DESCRIPTION OF THE PREFERRED EMBODIMENT

Figure 1:
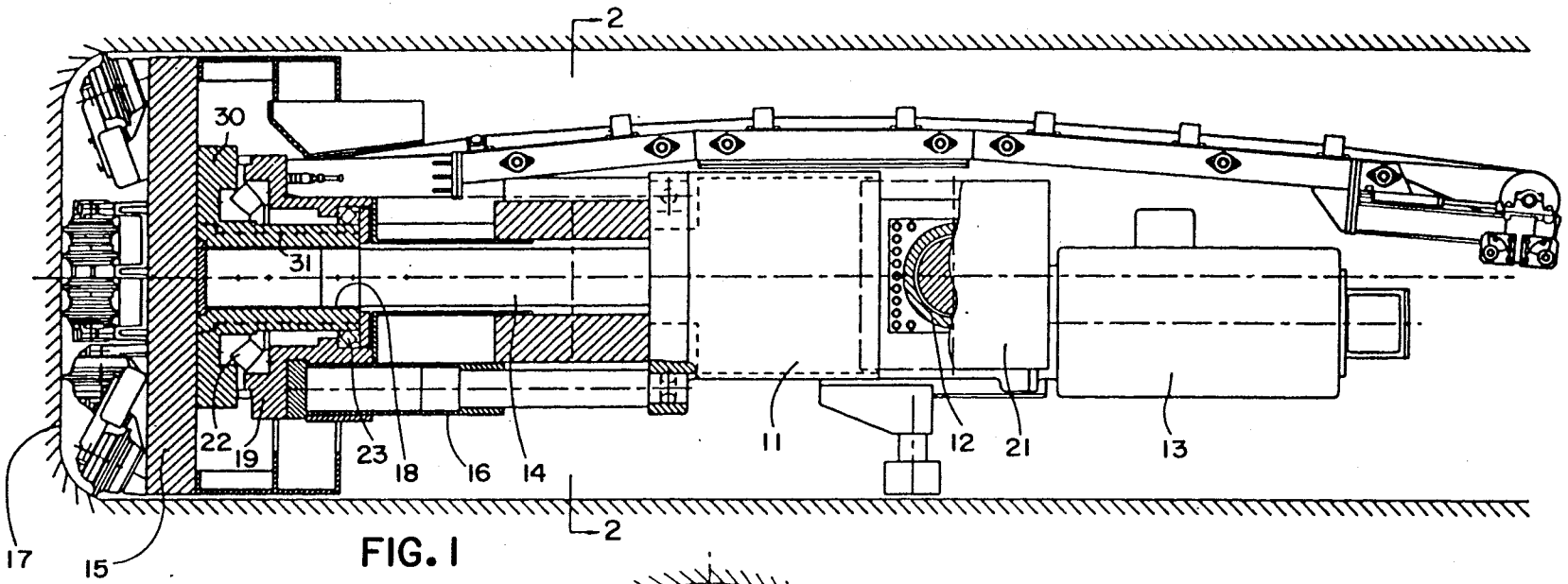
FIG. 1 shows a side view of a tunnel boring machine, partly in section.
Figure 2:
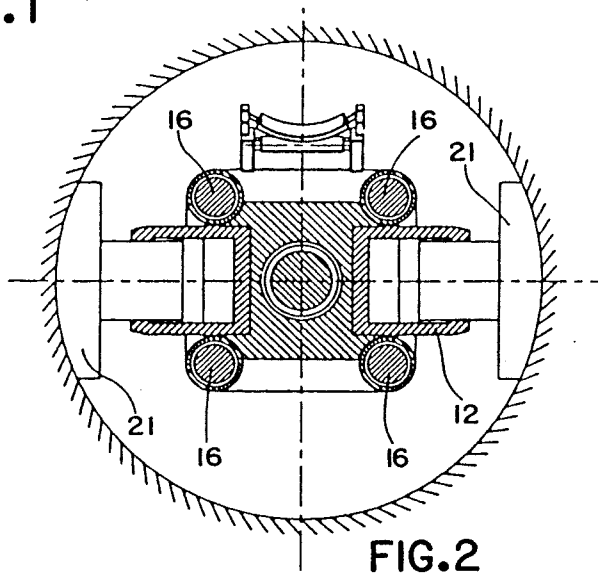
FIG. 2 shows a section according to 2—2 in FIG. 1.

The tunnel boring machine shown in the drawings comprises a transmission housing 11, one or more driving motors 13 arranged on the transmission housing and a boring head 15 which via an outgoing shaft 14 is connected to a transmission in the transmission housing 11. During boring the transmission housing 11 is held clamped in the tunnel by means of a number of clamping shoes 21 which are mounted in hydraulic cylinders 12. The boring head 15 is rotatably journalled in a bearing housing 19,30 by means of rolling bearings 22,23. The boring head 15 is fixedly mounted on one part 30 of the bearing housing. The bearing housing 19,30 and thus the boring head is connected to the outgoing shaft by means of a splined coupling 18. The coupling can be made in another way than via a splined coupling. The essential thing is that one has axial movability during transfer of torque. The boring head is fed against the tunnel front 17 by means of a number of fluid cylinders 16 arranged between the transmission housing 11 and the bearing housing 19,30. Through the above described build-up of the tunnel boring machine the advantage is achieved that the reactions of the torque and the feeding force are transferred directly from the transmission housing 11 to the surrounding tunnel wall because the transmission housing is fixed relative to the tunnel. Only the moment depending on friction in the bearings 22,23 is transferred to the bearing housing 19 from the boring head 15. Bearing housing part 30 may alternatively be provided with a sleeve 31 as marked with dashed line in FIG. 1. This sleeve is than a replaceable wear part. The outer surface of the sleeve is suitably somewhat conical so that the pressing in of the sleeve in part 30 results in a radial expansion of part 30. This results in a radial prestressing of bearings 22,23.

We claim:

1. Tunnel boring machine having a transmission housing which comprises a transmission driven by at least one driving motor arranged on said transmission housing, an outgoing shaft connected to said transmission for driving a boring head, and means for pressing the boring head against a tunnel front, said transmission housing during boring being fixed relative to the tunnel by means of a plurality of clamping shoes, said boring head being axially displaceable relative to said outgoing shaft while transferring torque from the outgoing shaft to the boring head, said means for pressing the boring head against the tunnel front comprising a plurality of fluid cylinders arranged between said transmission housing and a bearing housing for said boring head.

2. Tunnel boring machine according to claim 1, wherein said boring head is arranged on said bearing housing, such that the bearing housing comprises a replaceable sleeve which is axially displaceable along said outgoing shaft.

3. Tunnel boring machine according to claim 2, wherein said sleeve comprises a conical surface such that the pressing in of the sleeve the bearing housing results in that at least one bearing in the bearing housing is prestressed radially.

4. Tunnel boring machine according to claim 3, wherein said boring head is connected to said outgoing shaft via a splined coupling.

5. Tunnel boring machine according to claim 2, wherein said boring head is connected to said outgoing shaft via a splined coupling.

6. Tunnel boring machine according to claim 1, wherein said boring head is connected to said outgoing shaft via a splined coupling.

* * * * *